US009354573B2

(12) United States Patent
Lim et al.

(10) Patent No.: US 9,354,573 B2
(45) Date of Patent: May 31, 2016

(54) FUSING DEVICE AND IMAGE FORMING APPARATUS HAVING THE SAME

(75) Inventors: Jae Hyuk Lim, Seoul (KR); Jae Myoung Choi, Suwon-si (KR); Sang Cheol Moon, Suwon-si (KR); Hyun Il Kim, Suwon-si (KR); Choong Kyu Park, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 621 days.

(21) Appl. No.: 13/339,952

(22) Filed: Dec. 29, 2011

(65) Prior Publication Data

US 2012/0170957 A1 Jul. 5, 2012

(30) Foreign Application Priority Data

Jan. 4, 2011 (KR) ..... 10-2011-0000666

(51) Int. Cl.
*G03G 15/16* (2006.01)
*G03G 15/20* (2006.01)

(52) U.S. Cl.
CPC .... *G03G 15/2064* (2013.01); *G03G 2215/2035* (2013.01)

(58) Field of Classification Search
CPC ..... G03G 2215/2009; G03G 2215/2012; G03G 2215/2022; G03G 2215/2025; G03G 2215/2032
USPC ..... 399/122, 330, 331
See application file for complete search history.

(56) References Cited

U.S. PATENT DOCUMENTS

| | | | | |
|---|---|---|---|---|
| 5,708,926 | A * | 1/1998 | Sagara et al. | 399/122 |
| 2008/0298824 | A1 | 12/2008 | Kanno | |
| 2009/0232549 | A1 | 9/2009 | Foster et al. | |
| 2010/0189478 | A1 | 7/2010 | Takahashi | |
| 2011/0170920 | A1 * | 7/2011 | Fujiwara et al. | 399/331 |
| 2012/0148304 | A1 * | 6/2012 | Sugaya et al. | 399/122 |

FOREIGN PATENT DOCUMENTS

| | | |
|---|---|---|
| JP | 4-44080 | 2/1992 |
| JP | 2004-109521 | 4/2004 |
| JP | 2008-129092 | 6/2008 |
| JP | 2008-275886 | 11/2008 |
| JP | 2009-37103 | 2/2009 |

OTHER PUBLICATIONS

Chinese Office Action dated May 5, 2015 in corresponding Chinese Patent Application No. 201110459374.6.
Extended European Search Report dated May 19, 2015 in corresponding European Patent Application No. 11195201.6.

* cited by examiner

*Primary Examiner* — David Gray
*Assistant Examiner* — Andrew V Do
(74) *Attorney, Agent, or Firm* — Staas & Halsey LLP

(57) ABSTRACT

A fusing device and an image forming apparatus having the same are provided. The fusing device includes a position regulating device to regulate a position of a side frame which rotatably supports a fusing belt, thereby fixing a position of a fusing nip defined between the fusing belt, inside of which a heat source is placed, and a pressure roller arranged to face the fusing belt. The fusing device prevents shift of a recording medium delivery path due to deformation of the pressure roller.

20 Claims, 9 Drawing Sheets

1

FUSING DEVICE AND IMAGE FORMING APPARATUS HAVING THE SAME

CROSS-REFERENCE TO RELATED APPLICATIONS

This application is related to and claims priority to Korean Patent Application No. 10-2011-0000666, filed on Jan. 4, 2011 in the Korean Intellectual Property Office, the disclosure of which is incorporated herein by reference.

BACKGROUND

1. Field

The embodiments discussed herein relate to a fusing device to fix an image to a recording medium and an image forming apparatus having the same.

2. Description of the Related Art

An image forming apparatus is designed to print an image on a recording medium. Examples of image forming apparatuses include printers, copiers, fax machines, and devices combining functions thereof.

In an electro-photographic image forming apparatus, a photoconductor, which has been charged with a predetermined electric potential, may be exposed to light such that an electrostatic latent image is formed on a surface of the photoconductor. Thereafter, developer may be fed to the electrostatic latent image to form a visible image. The visible image formed on the photoconductor may be transferred to a recording medium and then, may be fixed to the recording medium while passing through a fusing device.

The fusing device includes a heating unit containing a heat source therein, and a pressure roller arranged to come into close contact with the heating unit to define a fusing nip with the heating unit. If the recording medium, on which the image has been transferred, is introduced into the fusing nip between the heating unit and the pressure roller, the image may be fixed to the recording medium by heat and pressure.

SUMMARY

According to an aspect of the present invention a fusing device is provided to prevent shift of a recording medium delivery path even if an outer diameter of a pressure roller is changed by repeatedly applied heat and pressure, and an image forming apparatus is provided having the same.

Additional aspects of embodiments of the present invention will be set forth in part in the description which follows and, in part, will be obvious from the description, or may be learned by practice of the invention.

In accordance with an aspect of an exemplary embodiment of the present invention, a fusing device includes a housing, a pressure roller rotatably installed in the housing, a heating unit arranged to face the pressure roller, the heating unit including a side frame slidably installed to the housing to rotatably support a film-shaped fusing belt inside of which a heat source is provided, a pressure unit to press the side frame such that the fusing belt comes into close contact with the pressure roller while defining a fusing nip therebetween, and a position regulating device to regulate a position of the side frame when the side frame is pressed and moved by the pressure unit, thereby fixing a position of the fusing nip.

One side of the side frame may be supported by the pressure unit and the other side of the side frame may be supported by the position regulating device, and the position regulating device may be slidably coupled to the housing.

The position regulating device may be movable between a first position to define the fusing nip upon receiving pressure applied by the pressure unit and a second position to release the pressure of the fusing nip.

The pressure unit may include a pressure lever supported by an elastic member to press the side frame.

One end of the pressure lever may be pivotally rotatably coupled to a pressure lever rotating shaft and the other end of the pressure lever may be supported by the elastic member, and a contact portion may be formed at a middle position of the pressure lever so as to come into contact with the side frame.

The fusing device may include a pressure release lever rotatably installed to the housing and serving to press the position regulating device so as to move the position regulating device to the second position upon rotation thereof.

The pressure release lever may include a pressure release lever rotating shaft, a lever portion extending in a given direction from the pressure release lever rotating shaft, and a cam face extending in an opposite direction from the pressure release lever rotating shaft so as to come into contact with the position regulating device.

The cam face may include a nip defining face spaced apart from a rotation center of the pressure release lever rotating shaft by a first distance and a nip release face spaced apart from the rotation center of the pressure release lever rotating shaft by a second distance.

The fusing device may include a cam unit to come into contact with the lever portion when rotated by a drive source, so as to rotate the pressure release lever.

The lever portion may be rotated in linkage with operation of an outer structure adjacent thereto.

The fusing device may include a control unit to control the drive source so as to adjust a rotation angle of the lever portion based on the kind of a recording medium fed to the fusing device.

The position regulating device may include a first coupling portion coupled to the side frame, a second coupling portion having a vertically elongated slot into which the pressure release lever rotating shaft is fitted, and a cam contact portion to come into contact with the cam face of the pressure release lever.

In accordance with an aspect of an exemplary embodiment of the present invention, an image forming apparatus includes a fusing device to heat a non-fused image on a recording medium so as to fuse the image to the recording medium, wherein the fusing device includes a housing, a heating device having a side frame slidably installed to the housing to rotatably support a film-shaped fusing belt inside of which a heat source is provided, a pressure roller rotatably installed in the housing so as to face the heating device, a pressure unit installed to the housing and serving to press the side frame toward the pressure roller so as to define a fusing nip between the fusing belt and the pressure roller, a position regulating device to regulate a position of the side frame when the side frame is moved by the pressure unit, so as to prevent shift of a position of the fusing nip due to deformation of the pressure roller, and a pressure release lever installed to the housing so as to be rotatable by a predetermined angle and serving to press the position regulating device upon rotation thereof so as to release pressure of the fusing nip between the fusing belt and the pressure roller.

One side of the position regulating device may be supported by the side frame and the other side of the position regulating device may be supported by the pressure release lever.

The position regulating device may be movable between a first position to define the fusing nip and a second position to release the pressure of the fusing nip.

The pressure unit may include a pressure lever, one end of which is rotatably supported by the housing and the other end of which is supported by an elastic member to press the side frame.

The position regulating device may prevent the side frame from being moved toward the pressure roller beyond the first position by the pressure lever.

The pressure release lever rotatably installed to the housing may be provided at one end thereof with a cam face to come into contact with the position regulating device and at the other end thereof with a lever portion to pivotally rotate the pressure release lever.

The cam face may include a nip defining face to keep the position regulating device at the first position and a nip release face to keep the position regulating device at the second position.

The fusing device may include a cam unit to come into contact with the lever portion when rotated by a drive source, so as to rotate the pressure release lever.

The image forming apparatus may include a cover to open or close one side of a main body, and the lever portion may be operated in linkage with operation of the cover.

The image forming apparatus may include a control unit to control the drive source, and the control unit may operate the drive source so as to control a rotation angle of the lever portion based on the kind of a recording medium delivered into the fusing device.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
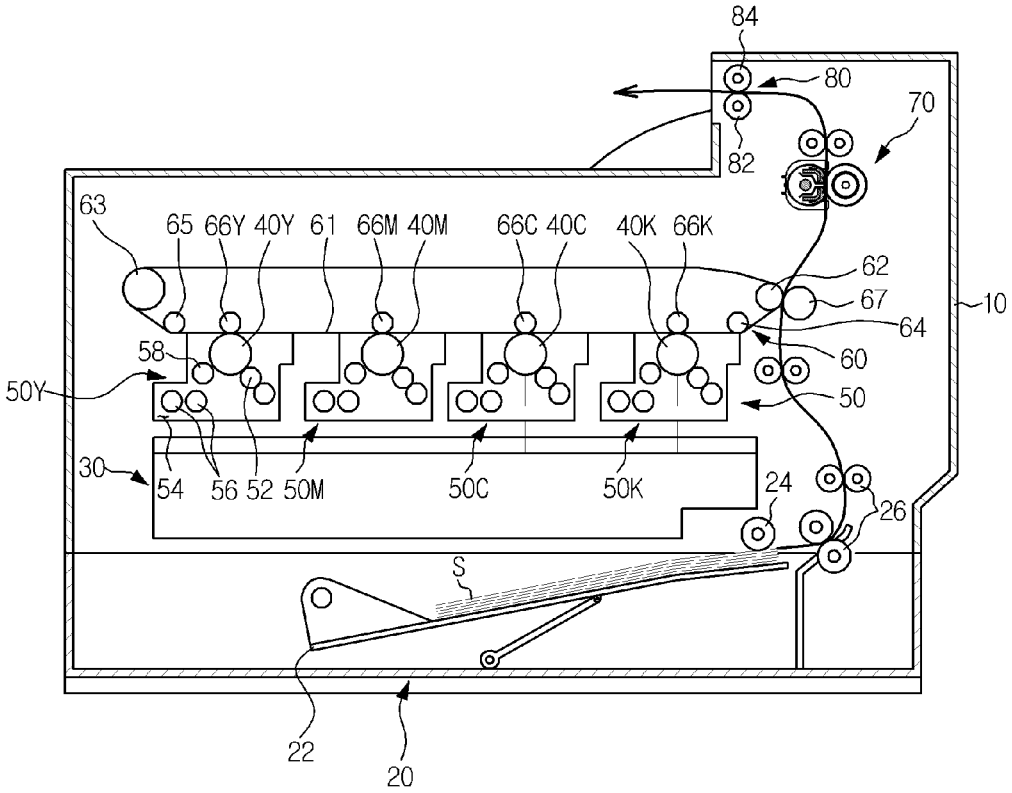
FIG. 1 illustrates an image forming apparatus according to an exemplary embodiment.

Reference will now be made in detail to the exemplary embodiments of the present invention, examples of which are illustrated in the accompanying drawings, wherein like reference numerals refer to like elements throughout. FIG. 1 illustrates an image forming apparatus according to an exemplary embodiment.

As illustrated in FIG. 1, the image forming apparatus 1 includes a main body 10, a recording medium feeding device 20, a light scanning device 30, a plurality of photoconductors 40Y, 40M, 40C and 40K, a developing device 50, a transfer device 60, a fusing device 70, and a recording medium discharge device 80.

The main body 10 defines an external appearance of the image forming apparatus and supports a variety of elements installed therein. The main body 10 may be provided with an opening/closing part to allow the user to access the interior of the main body 10 through an opening of the main body 10 when it is desired to replace or repair the variety of elements or to remove a recording medium jammed in the main body 10.

The recording medium feeding device 20 feeds recording media S toward the transfer device 60. The recording medium feeding device 20 includes a cassette 22 in which the recording media S are accommodated, a pickup roller 24 to pick up the recording media S accommodated in the cassette 22 one by one, and delivery rollers 26 to deliver the picked-up recording medium toward the transfer device 60.

The light scanning device 30 irradiates light corresponding to image information to the photoconductors 40Y, 40M, 40C and 40K to form electrostatic latent images on surfaces of the photoconductors 40Y, 40M, 40C and 40K. Although not illustrated in the drawings, the light scanning device 30 may include a light source to emit light beams, a deflector including a polygonal mirror to deflect the light beams when rotated by a motor, and an f-theta lens to focus the deflected light beams to the photoconductors.

The developing device 50 forms visible images by supplying developers to the electrostatic latent images formed on the photoconductors 40Y, 40M, 40C and 40K. The developing device 50 consists of four developing units 50Y, 50M, 50C and 50K in which different colors of developers, for example, black K, cyan C, magenta M, and yellow Y developers are accommodated respectively.

The developing units 50Y, 50M, 50C and 50K may respectively include charging members 52, developer reservoirs 54, developer delivery members 56, and developing members 58. The charging members 52 charge the surfaces of the photoconductors 40Y, 40M, 40C and 40K before the electrostatic latent images are formed on the photoconductors 40Y, 40M, 40C and 40K. The developer delivery members 56 deliver the developers stored in the developer reservoirs 54 to the developing members 58. The developing members 58 supply the developers to the electrostatic latent images formed on the photoconductors 40Y, 40M, 40C and 40K to form visible images.

Although FIG. 1 illustrates an exemplary embodiment in which the four photoconductors 40Y, 40M, 40C and 40K are provided respectively in the developing units 50Y, 50M, 50C and 50K Alternatively, four developing units form a visible image on a single photoconductor.

The transfer device 60 transfers visible images from the photoconductors 40Y, 40M, 40C and 40K to the recording medium. The transfer device 60 includes a transfer belt 61, a drive roller 62, a support roller 63, tension rollers 64 and 65, and transfer rollers 66Y, 66M, 66C and 66K.

The transfer belt 61 may be rotatably supported by the drive roller 62 and the support roller 63. The drive roller 62 may be rotated upon receiving power from a drive source (not shown) mounted in the main body 10. The support roller 63 may be located at an opposite side of the drive roller 62 to support an inner surface of the transfer belt 61.

The respective photoconductors 40Y, 40M, 40C and 40K may be arranged to face an outer surface of the transfer belt 61. The transfer rollers 66Y, 66M, 66C and 66K may be arranged to support the inner surface of the transfer belt 61 at positions corresponding to the respective photoconductors 40Y, 40M, 40C and 40K.

When the image forming apparatus 1 performs a color printing operation, the transfer rollers 66Y, 66M, 66C and 66K are pushed toward the respective photoconductors 40Y, 40M, 40C and 40K. Thus, the transfer rollers 66Y, 66M, 66C and 66K transfer the visible images formed on the respective photoconductors 40Y, 40M, 40C and 40K to the transfer belt 61 such that the images overlap one another on the transfer belt 61. The resulting image on the transfer belt 61 may be transferred to the recording medium fed from the recording medium feeding device 20 while the recording medium passes between the transfer roller 67 and the transfer belt 61.

When the image forming apparatus 1 performs a black-and-white printing operation, only the transfer roller 66K is pushed toward the photoconductor 40K, and the other transfer rollers 66Y, 66M and 66C are spaced apart from the corresponding photoconductors 40Y, 40M and 40C.

The recording medium having passed through the transfer device 60 enters the fusing device 70. As the fusing device 70 applies heat and pressure to the recording medium, the non-fused image on the recording medium is fixed to the recording medium.

The recording medium having passed through the fusing device 70 may be guided to the recording medium discharge device 80 to thereby be discharged out of the main body 10 by the recording medium discharge device 80. The recording medium discharge device 80 includes a discharge roller 82 and a discharge backup roller 84 facing the discharge roller 82.

Figure 2:
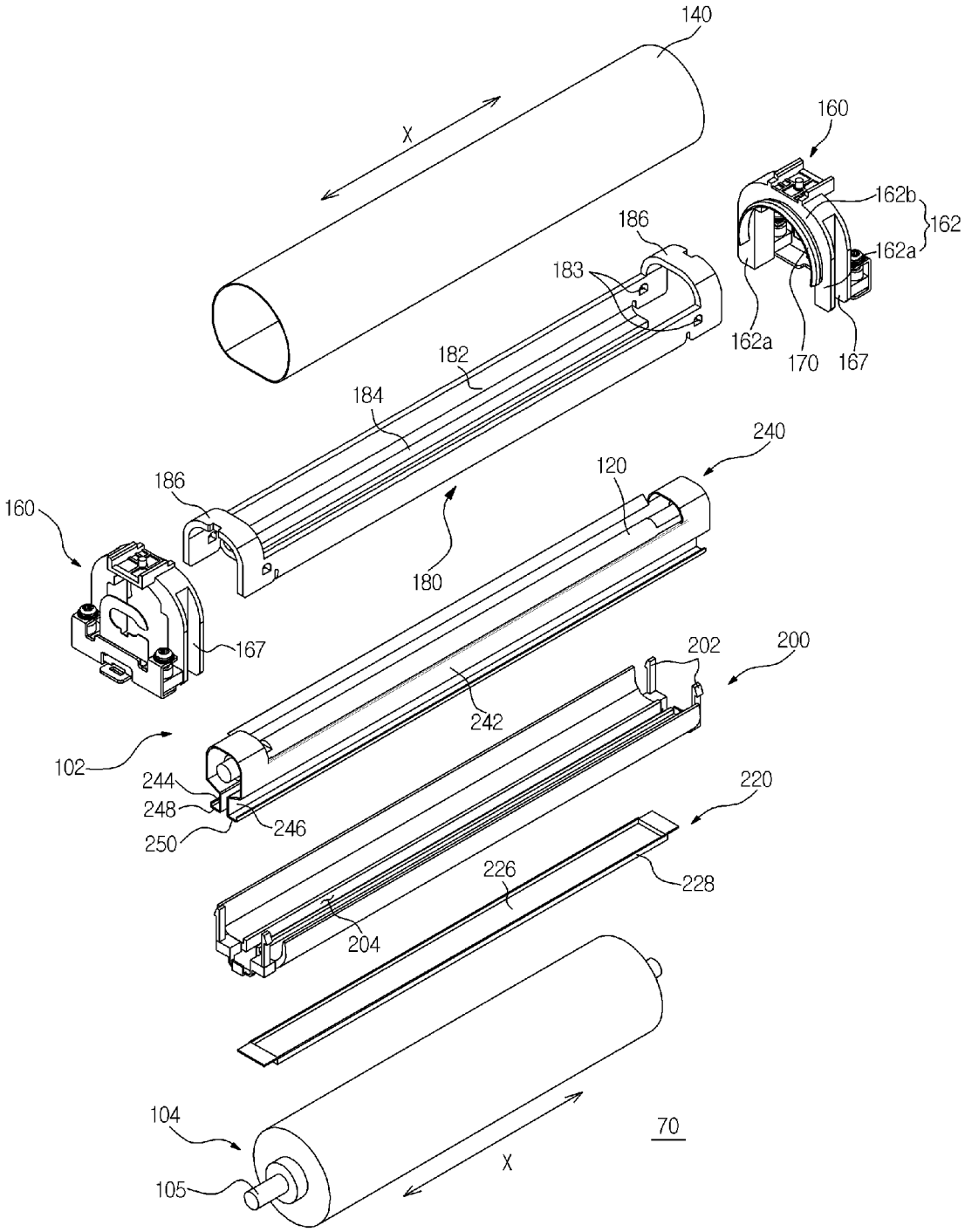
FIG. 2 is an exploded perspective view illustrating a fusing device according to an exemplary embodiment.
Figure 3:
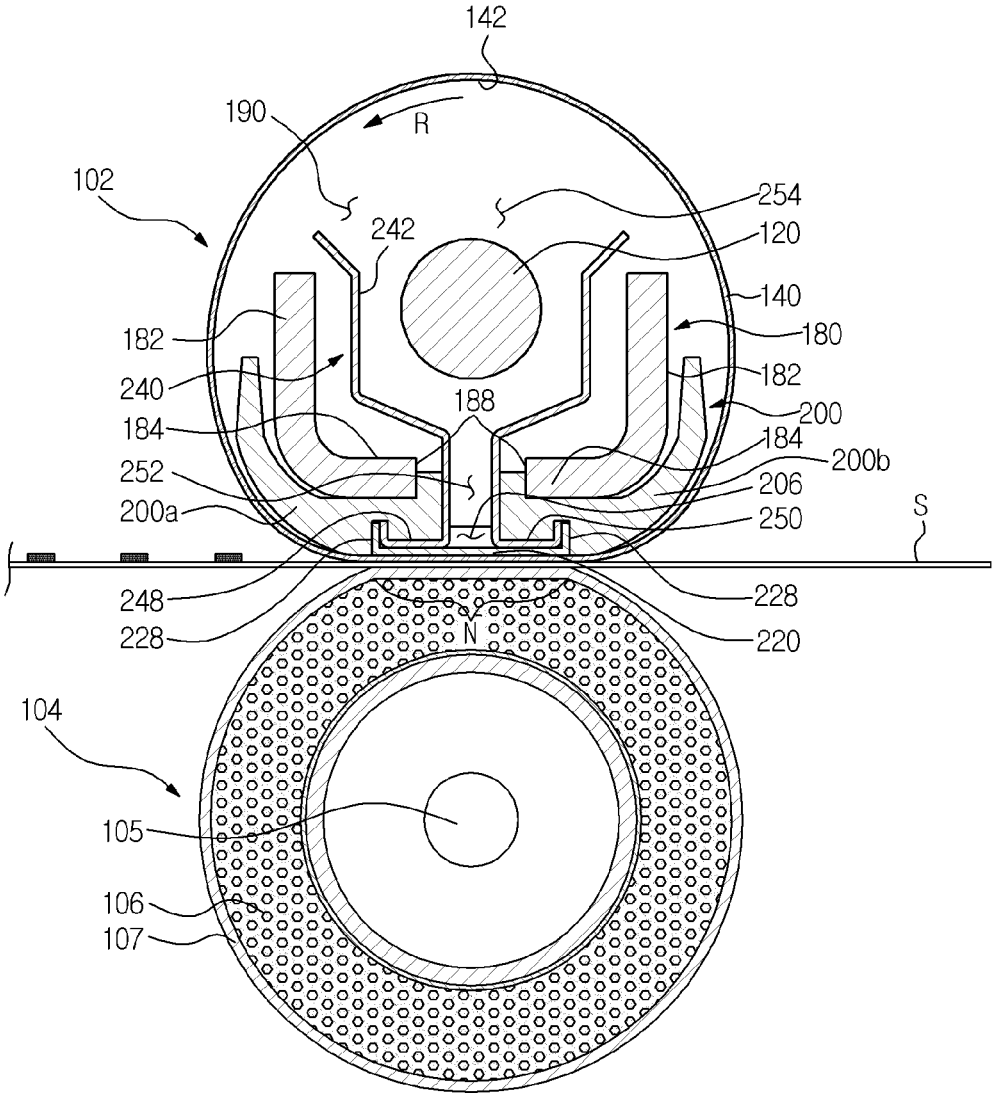
FIG. 3 is a sectional view of a fusing device according to an exemplary embodiment.

FIGS. 2 and 3 respectively illustrate an exploded perspective view and a sectional of a fusing device according to an exemplary embodiment.

As illustrated in FIGS. 2 and 3, the fusing device 70 includes a heating unit 102 and a pressure roller 104. A longitudinal direction X of the fusing device 70 may be defined as a direction corresponding to an axial direction of the pressure roller 104. The longitudinal direction X of the fusing device 70 may be represented as a longitudinal direction of constituent elements of the heating unit 102 including, e.g., a fusing belt 140, a belt guide member 200, and a nip plate 220.

The heating unit 102 and the pressure roller 104 may be arranged to face each other to define a fusing nip N through which the recording medium S passes. The heating unit 102 may be arranged to come into contact with a surface of the recording medium S on which a non-fused image has been formed, so as to apply heat to the recording medium S. The pressure roller 104 may be arranged to come into press contact with the heating unit 102.

The heating unit 102 includes a heat source 120 to generate heat and the fusing belt 140 rotatably placed around the heat source 120. The fusing belt 140 may be rotatably engaged with the pressure roller 104.

The pressure roller 104 may be arranged to face the fusing belt 140. The pressure roller 104 comes into close contact with the fusing belt 140 to define the fusing nip N when a predetermined pressure may be applied thereto. The pressure roller 104 may be rotated upon receiving power from the drive source (not shown) mounted in the main body 10. While the recording medium S, on which the developer image has been transferred, passes through the fusing nip N between the pressure roller 104 and the fusing belt 140, the developer image may be fixed to the recording medium S by heat and pressure.

The pressure roller 104 includes a shaft 105 and an elastic layer 106. The shaft 105 may be located in the center of the pressure roller 104 and functions as a rotating shaft. The shaft 105 also functions to support elements placed thereon. The shaft 105 may be made of a metallic material, such as aluminum or steel. The elastic layer 106 may be configured to surround the shaft 105 and is elastically deformed when the pressure roller 104 comes into press contact with the fusing belt 140, thereby allowing the fusing nip N to be defined between the pressure roller 104 and the fusing belt 140. The elastic layer 106 may be made of silicon rubber.

A release layer 107 may be provided on a surface of the elastic layer 106 to prevent the recording medium from being adhered to the pressure roller 104. The release layer 107 may be a tubular layer made of fluorine resin, such as perfluoroalkoxy (PFA).

Both ends of the fusing belt 140 with respect to the longitudinal direction X of the fusing belt 140 may be rotatably supported by side frames 160. The fusing belt 140 may be heated by the heat source 120 and transfers heat to the recording medium S passing through the fusing nip N.

The heat source 120 may be placed inside the fusing belt 140. As both ends of the heat source 120 are respectively coupled to side covers 121 and the side covers 121 are secured to the side frames 160, the heat source 120 may be supported by the side frames 160. The heat source 120 may include at least one halogen lamp or heater.

The side frames 160 are respectively arranged at opposite sides of the fusing belt 140 in the longitudinal direction X of the fusing belt 140. Each of the side frames 160 includes a restraint wall 162 to prevent longitudinal movement of the fusing belt 140 and a side belt guide 170 to support an inner surface of the end of the fusing belt 140. The restraint wall 162 includes two legs 162*a* arranged side by side with a distance therebetween and a connector 162*b* to connect the two legs 162*a* to each other.

The side belt guide 170 protrudes from the restraint wall 162 and may be inserted into the fusing belt 140. The side belt guide 170 precisely extends throughout the two legs 162*a* and the connector 162*b*. An outer circumference of the side belt guide 170 supports the inner surface of the end of the fusing belt 140 to guide rotation of the fusing belt 140.

A support member 180 may be placed between the two side frames 160. The support member 180 serves as a basic framework to support constituent elements of the heating unit 102 and thus, may be made of a material having high rigidity so as not to be easily deformed by external force.

The support member 180 may include support plates 182, bending plates 184 and connecting plates 186.

The support plates 182 extend in the longitudinal direction X of the fusing device 70 between the two side frames 160 and are arranged in parallel to each other with a distance therebetween. The connecting plates 186 connect longitudinal ends of the support plates 182 to each other. The connecting plates 186 are inserted into the side frames 160 so as to be coupled thereto. An assembly of the support member 180 and the side frames 160 defines a framework of the heating unit 102.

The bending plates 184 are bent inward from the support plates 182. The bending plates 184 are seated on an inner surface of the belt guide member 200 to support the belt guide member 200.

The bending plates 184 define a first opening 188 therebetween. Heat radiated from the heat source 120 may be partially transferred to the fusing nip N through the first opening 188.

The support member 180 has a second opening 190 at an opposite side of the first opening 188. The second opening 190 allows the heat radiated from the heat source 120 to directly pass through the support member 180 to thereby directly reach the fusing belt 140.

The belt guide member 200 supports an inner surface 142 of the fusing belt 140 near the fusing nip N and guides rotation of the fusing belt 140. The belt guide member 200 extends in the longitudinal direction X of the fusing belt 140.

The belt guide member 200 may be provided at both longitudinal ends thereof with hooks 202 protruding toward the support member 180. The support plates 182 of the support member 180 have fastening holes 183 corresponding to the hooks 202. As the hooks 202 are inserted between the support plates 182 and then, noses of the hooks 202 are caught by the fastening holes 183, the belt guide member 200 may be coupled to the support member 180.

The belt guide member 200 may have a third opening 204 corresponding to the first opening 188 of the support member 180. The heat radiated from the heat source 120 may be directly transferred to the fusing nip N through the first opening 188 of the support member 180 and the third opening 204 of the belt guide member 200.

The belt guide member 200 includes a first guide 200*a* and a second guide 200*b* respectively arranged upstream and downstream of the third opening 204 with respect to a rotating direction R of the fusing belt 140. Outer surfaces of the first guide 200*a* and the second guide 200*b* guide smooth rotation of the fusing belt 140. Ends of the first guide 200*a* and the second guide 200*b* of the belt guide member 200 are connected to both ends of the arcuate side belt guide 170.

An outer surface of the belt guide member 200 facing the inner surface 142 of the fusing belt 140 may be provided with an accommodation groove 206 in the longitudinal direction X of the fusing belt 140. The accommodation groove 206 communicates with the third opening 204 of the belt guide member 200. The accommodation groove 206 extends in opposite directions from the third opening 204 such that a part of the groove 206 may be formed in the first guide 200*a* and another part of the groove 206 may be formed in the second guide 200*b*.

The nip plate 220 may be placed in the accommodation groove 206 of the belt guide member 200. The nip plate 220 supports the inner surface 142 of the fusing belt 140 to ensure that the fusing nip N may be defined between an outer surface of the fusing belt 140 and the pressure roller 104.

The nip plate 220 includes a pressure portion 226 extending in the longitudinal direction X of the fusing belt 140. The pressure portion 226 comes into contact with the inner surface 142 of the fusing belt 140 to apply pressure to the fusing belt 140 against the pressure roller 104. Rim walls 228 protrude from opposite transversal ends of the pressure portion 226.

The nip plate 220 may be made of a material having low specific heat and high thermal conductivity to efficiently transfer heat to the recording medium. For example, the nip plate 220 may be made of aluminum. The nip plate 220 may be provided with an oxide film (not shown) via anodizing, and a ceramic-Teflon coating layer may be formed on the oxide film.

The nip plate 220 applies pressure to the inner surface 142 of the fusing belt 140 while the pressure roller 104 applies pressure to the outer surface of the fusing belt 140. If excessive friction occurs between the fusing belt 140 and the nip plate 220, the fusing belt 140 may be damaged or efficient rotation of the fusing belt 140 may be impossible. Thus, to reduce friction between the fusing belt 140 and the nip plate 220, a lubricant, such as grease, may be applied to the inner surface 142 of the fusing belt 140.

A heat transfer member 240 may be placed between the heat source 120 and the fusing belt 140. The heat transfer member 240 includes a body 242 and first and second legs 244 and 246.

The body 242 may be configured to surround the heat source 120 and may be heated by the heat source 120. The first leg 244 extends from one end of the body 242 toward the fusing belt 140 and the second leg 246 extends from the other end of the body 242 toward the fusing belt 140. The first leg 244 and the second leg 246 are fitted through the first opening 188 of the support member 180 and the third opening 204 of the belt guide member 200. An inner surface of the belt guide member 200 defining the third opening 204 supports outer surfaces of the first leg 244 and the second leg 246 of the heat transfer member 240.

The end of the first leg 244 may be bent toward the first guide 200*a* of the belt guide member 200 to form a first heat transfer portion 248. The end of the second leg 246 may be bent toward the second guide 200*b* of the belt guide member 200 to form a second heat transfer portion 250.

Each of the first heat transfer portion 248 and the second heat transfer portion 250 has one surface coming into contact with the nip plate 220 to transfer heat to the nip plate 220, the other surface of the first heat transfer portion 248 or the second heat transfer portion 250 being supported by the outer surface of the belt guide member 200.

A fourth opening 252 may be defined between the first leg 244 and the second leg 246. The heat source 120 directly heats the nip plate 220 through the fourth opening 252 of the heat transfer member 240, and the heated nip plate 220 transfers heat to the fusing belt 140.

The body 242 of the heat transfer member 240 includes a fifth opening 254 at an opposite side of the fourth opening 252. Thus, the heat source 120 may directly heat the fusing belt 140 through the fifth opening 254 of the heat transfer member 240 and the second opening 190 of the support member 180. This may allow a more rapid increase in the temperature of the fusing belt 140 and may prevent the temperature of the fusing belt 140 from dropping during rotation of the fusing belt 140.

Figure 4:
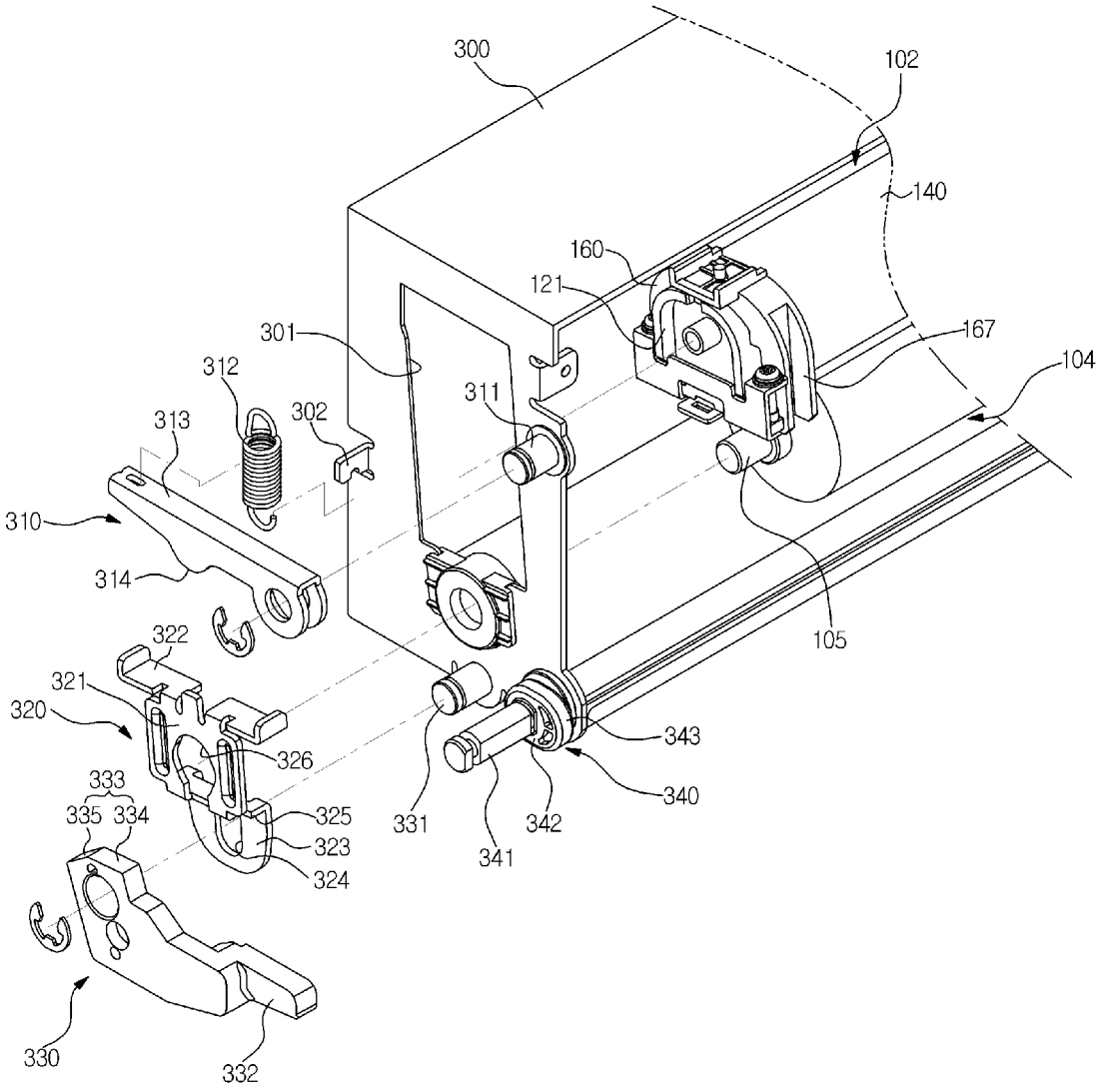
FIG. 4 is an exploded perspective view illustrating a coupling relationship between a heating unit and a pressure roller according to an exemplary embodiment.
Figure 5:
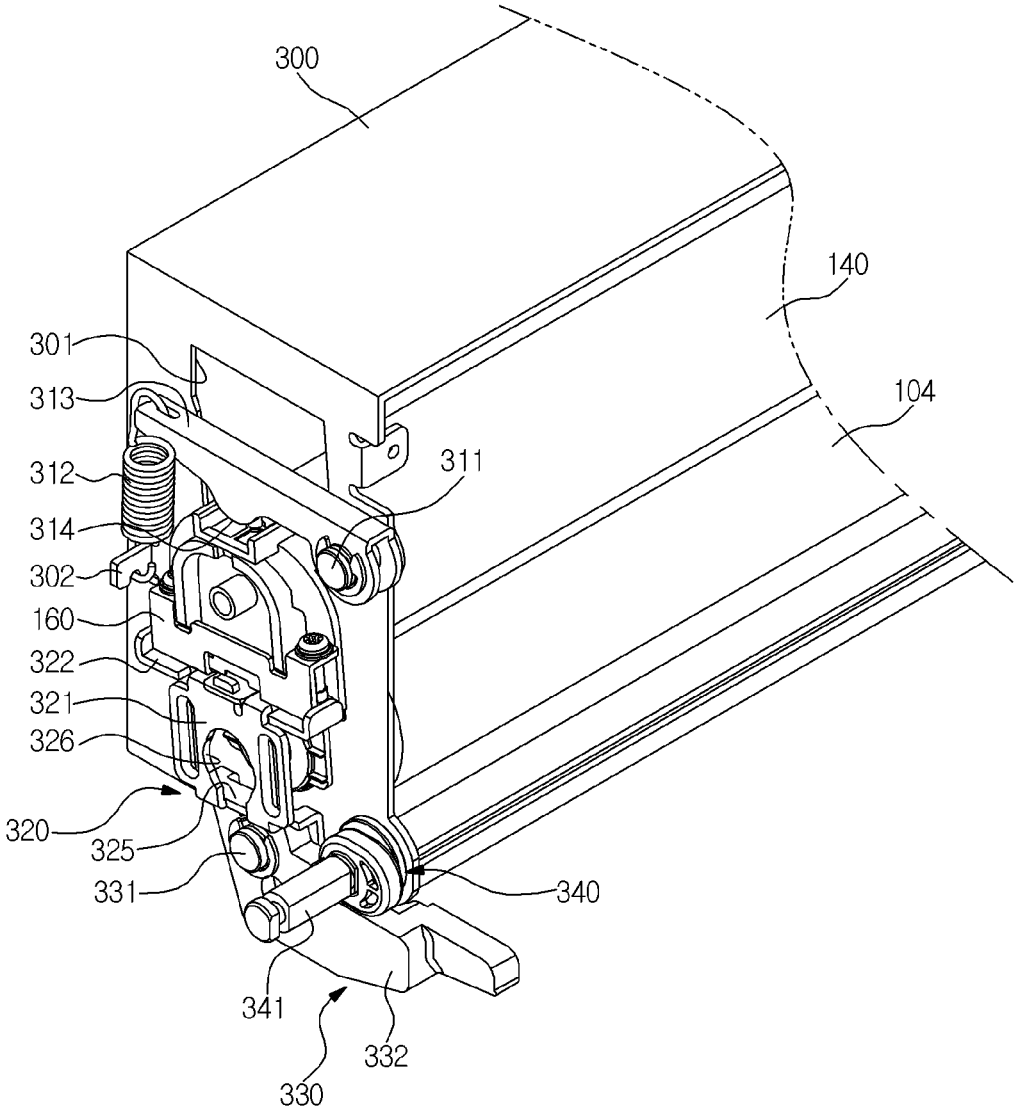
FIG. 5 is a perspective view illustrating a coupled state of the heating unit and the pressure roller according to an exemplary embodiment.
Figure 6:
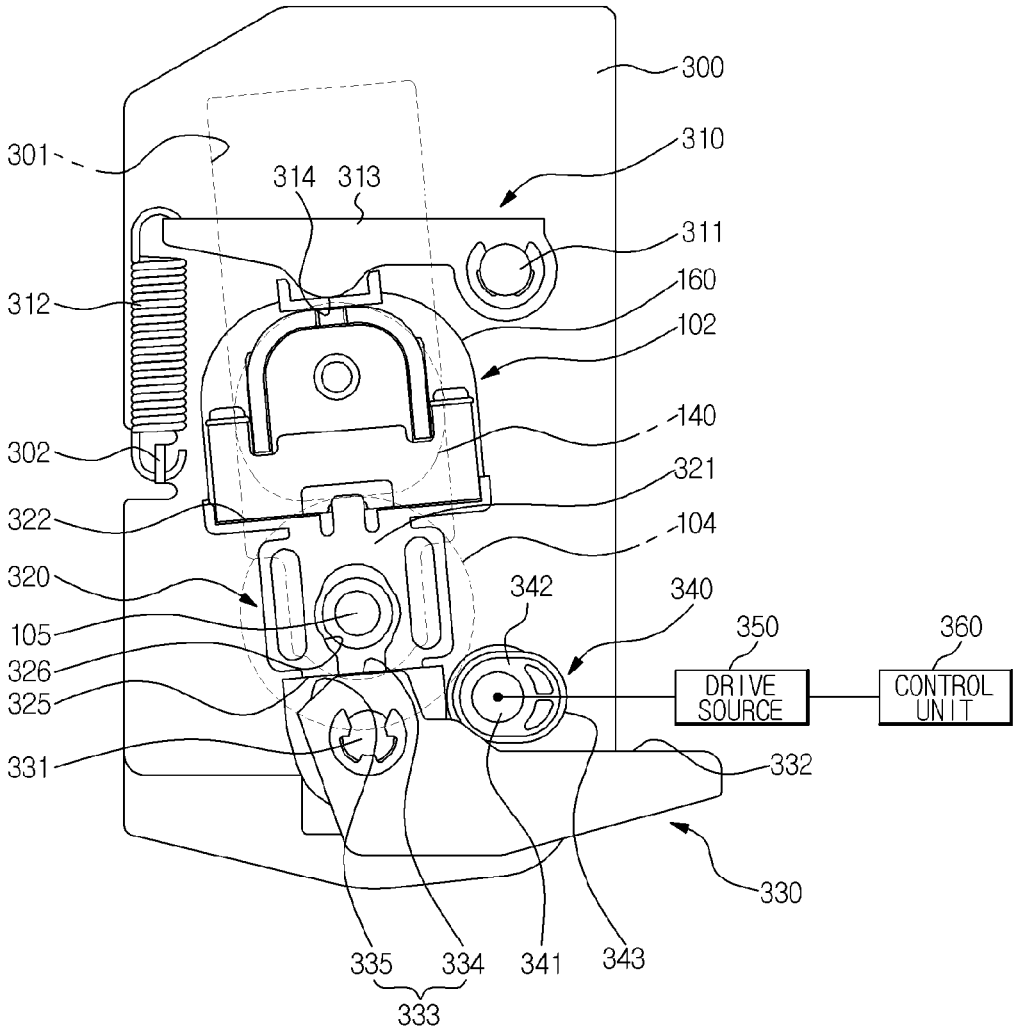
FIG. 6 is a side view of an exemplary embodiment illustrated in FIG. 5.

FIG. 4 is an exploded perspective view illustrating a coupling relationship between a heating unit and a pressure roller according to an exemplary embodiment, FIG. 5 is a perspective view illustrating a coupled state of a heating unit and a pressure roller according to an exemplary embodiment, and FIG. 6 is an example side view of FIG. 5.

As illustrated in FIGS. 4 to 6, the heating unit 102 and the pressure roller 104 of the present embodiment may be installed in a housing 300 such that both ends thereof are supported by the housing 300.

The heating unit 102 may be slidably installed to the housing 300. The pressure roller 104 may be rotatably installed at a fixed position within the housing 300.

The shaft 105 of the pressure roller 104 may penetrate through the housing 300 so as to receive power from the drive source (not shown) mounted in the main body 10.

The housing 300 may have a guide groove 301 to guide sliding of the heating unit 102. The side frame 160 may be fitted to the guide groove 301.

The side frame 160 may have a guide slot 167 for coupling with the guide groove 301. Once the guide slot 167 has been coupled with the guide groove 301, the side frame 160 is moved along the guide groove 301.

As the side frame 160 is moved toward the pressure roller 104 facing thereto, the fusing belt 140 comes into contact with the pressure roller 104 so as to define the fusing nip N.

To apply predetermined pressure required to define the fusing nip N, the housing 300 may be provided with a pressure unit 310 to press the side frame 160 toward the pressure roller 104.

The pressure unit 310 may include a pressure lever 313, one end of which is rotatably supported on a pressure lever rotating shaft 311 and the other end of which is supported by an elastic member 312.

The pressure lever 313 may be provided at an approximately central position thereof with a rounded contact portion 314 to come into contact with the side frame 160. The contact portion 314 applies pressure to the side frame 160 under assistance of the elastic member 312, thereby allowing the side frame 160 to be moved toward the pressure roller 104.

The elastic member 312 may be a tension spring, one end of which may be supported by a spring support 302 of the housing 300 and the other end of which may be supported by the pressure lever 313.

Although the pressure unit 310 may include the pressure lever 313, one end of which may be rotatably supported by the housing 300 and the other end of which may be supported by the elastic member 312, other shapes of members may be used that are adapted to continuously apply elastic force to move the side frame 160 toward the pressure roller 104.

As the pressure unit 310 presses the side frame 160, the heating unit 102 is moved toward the pressure roller 104. Thereby, as the fusing belt 140 of the heating unit 102 comes into contact with the pressure roller 104 at a predetermined pressure, the fusing nip N may be defined between the fusing belt 140 and the pressure roller 104.

A non-fused image on the recording medium S delivered to the fusing device 70 may be fused to the recording medium S by heat and pressure while passing through the fusing nip N.

Figure 7:
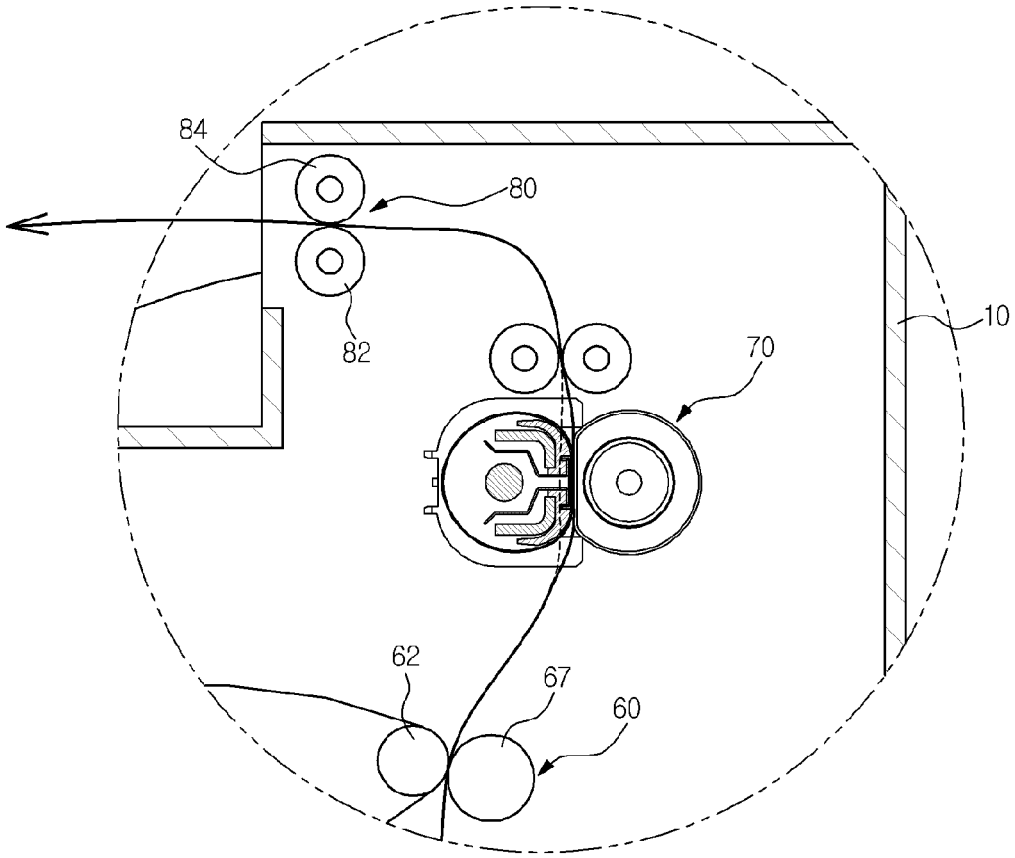
FIG. 7 illustrates a recording medium delivery path that is shifted due to deformation of a conventional pressure roller.

As heat and pressure are repeatedly applied to the pressure roller 104, the elastic layer 106 of the pressure roller 104 undergoes a minute reduction in an outer diameter thereof. Thus, the fusing belt 140, which has been pressed at a constant pressure by the pressure unit 310, may be moved toward the pressure roller 104 by a distance equal to the reduced outer diameter of the pressure roller 104. As illustrated in FIG. 7, the fusing nip N between the fusing belt 140 and the pressure roller 104 may be shifted from an initial position represented by a dotted line to a position represented by a solid line.

This may shift positions of a variety of rollers from a delivery path of the recording medium S between the transfer device 60 and the fusing device 70 or between the fusing device 70 and the recording medium discharge device 80, resulting in unstable behavior of the recording medium S.

Change in the outer diameter of the pressure roller 104 may cause change in the linear speed of the pressure roller 104, which may result in uneven delivery of the recording medium S and thus, defective images, such as one-sided images or wrinkled images, or jamming.

To prevent the above-described phenomenon, in the present embodiment, a position regulating device 320 may be provided to control a position of the side frame 160 when the side frame 160 may be moved upon receiving pressure from the pressure unit 310, thereby fixing a position of the fusing nip N.

The position regulating device 320 restricts the side frame 160 from moving beyond a predetermined distance when the pressure unit 310 applies pressure to the side frame 160 to move the side frame 160 toward the pressure roller 104, thereby keeping the fusing nip N at an initially preset position.

The position regulating device 320 may include a body 321 in the form of a plate having a predetermined rigidity, a first coupling portion 322 provided at one side of the body 321 to support the side frame 160, and a second coupling portion 323 provided at the other side of the body 321 and coupled to the housing 300, the first coupling portion 322 being formed by bending.

The body 321 may have a shaft hole 326 through which the shaft 105 of the pressure roller 104 penetrates. The shaft hole 326 may have a greater diameter than that of the shaft 105, and prevents the body 321 from interfering with the shaft 105 during movement thereof.

The first coupling portion 322 may be secured to the side frame 160 so as to be moved along with the side frame 160.

The second coupling portion 323 may have an elongated slot 324, through which a pressure release lever rotating shaft 331 provided at the housing 300 penetrates.

A stepped cam contact portion 325 may be provided between the body 321 and the second coupling portion 323. The cam contact portion 325 may come into contact with a pressure release lever 330.

The position regulating device 320 is movable between a first position to apply pressure to the pressure roller 104 so as to define the fusing nip N between the fusing belt 140 and the pressure roller 104 and a second position spaced apart from the pressure roller 104 to release the pressure applied to the fusing nip N.

The position regulating device 320 may be supported by the pressure release lever 330 so as not to be moved beyond the first position thereof for defining the fusing nip N at the initially preset position.

The pressure release lever 330 may be rotatably coupled to the pressure release lever rotating shaft 331. The pressure release lever 330 may include a lever portion 332 extending in a given direction from the pressure release lever rotating shaft 331 and a cam face 333 extending in an opposite direction from the pressure release lever rotating shaft 331.

The cam face 333 comes into contact with the cam contact portion 325 of the position regulating device 320. The cam face 333 may include a nip defining face 334 and a nip release face 335. The nip defining face 334 prevents the side frame 160 from being moved beyond a predetermined distance toward the pressure roller 104 upon receiving pressure from the pressure unit 310. The nip release face 335 functions to apply pressure to the position regulating device 320 in an opposite direction of the pressure applied by the pressure unit 310, thereby releasing the pressure applied to the fusing nip N.

A straight distance from the rotation center of the pressure release lever rotating shaft 331 to the nip defining face 334 may be less than a straight distance from the rotation center of the pressure release lever rotating shaft 331 to the nip release face 335.

Thus, if the pressure release lever 330 may be rotated, the nip release face 335 presses the position regulating device 320, causing the position regulating device 320 to press the side frame 160. Thereby, the fusing belt 140 coupled to the side frame 160 may be spaced apart from the pressure roller 104.

When the position regulating device 320 may be pressed and moved by the pressure unit 310, the nip defining face 334 may function to prevent the position regulating device 320 from being moved toward the pressure roller 104 beyond a predetermined range.

The nip defining face 334 restricts movement of the side frame 160 supported by the position regulating device 320 by restricting movement of the position regulating device 320. This serves to prevent the side frame 160 from being moved from the initially preset position of the fusing nip N and pressing the pressure roller 104 when moved toward the pressure roller 104 by the pressure unit 310.

The movement of the position regulating device 320 may be restricted by the nip defining face 334 of the pressure release lever 330, or the movement of the position regulating device 320 may be restricted using a stopper protruding from the housing 300 if the pressure release lever 330 is not provided.

A cam unit 340 to rotate the lever portion 332 may be installed at the housing 300 near the lever portion 332 of the pressure release lever 330.

The cam unit 340 may include a cam body 342 having an eccentric rotation center, and a cam shaft 341 axially coupled to the cam body 342 so as to rotate the cam body 342. The cam shaft 341 is rotated upon receiving power from the drive source (not shown) mounted in the main body 10.

The cam body 342 may have an elliptical shape. The elliptical cam body 342 may be provided at an outer circumferential surface thereof with a lever contact portion 343 to come into surface contact with the lever portion 332 of the pressure release lever 330.

The cam unit 340 rotates the pressure release lever 330 using a drive source 350 (e.g., a drive motor) instead of the user who directly rotates the pressure release lever 330. A recording medium sensor (not shown) to measure a thickness of the recording medium S may be placed in the main body 10. The sensed signal from the recording medium sensor may be transmitted to a control unit 360. The control unit 360 operates the drive source 350 coupled to the cam shaft 341 of the cam unit 340 so as to adjust a rotation angle of the cam unit 340.

Considering a control method of the cam unit 340 depending on the thickness of the recording medium S, the recording medium sensor (not shown) measures the thickness of the recording medium S in a state in which the image forming apparatus may be turned on, and the measured signal may be transmitted to the control unit 360.

Instead of measuring the thickness of the recording medium S using the sensor, the user may select the kind of the recording medium S using a setting device, such as a User Interface (UI) or a printer driver. The selected value may first be stored in a storage medium, such as a memory, and thereafter, be transmitted to the control unit 360.

The control unit 360 operates the drive source 350 based on the stored information about the recording medium S so as to rotate the cam body 342. As the rotated cam body 342 presses the lever portion 332 of the pressure release lever 330 so as to operate the pressure release lever 330, the pressure of the fusing nip N between the fusing belt 140 and the pressure roller 104 may be changed.

The pressure of the fusing nip N may be changed based on the kind of the recording medium S. For example, a thin recording medium S may undergo excessive curling, and the pressure of the fusing nip N may be released to reduce curling. With a recording medium such as an envelope, the pressure of the fusing nip N may be increased to prevent generation of wrinkles or adherence between the envelopes.

Figure 8:
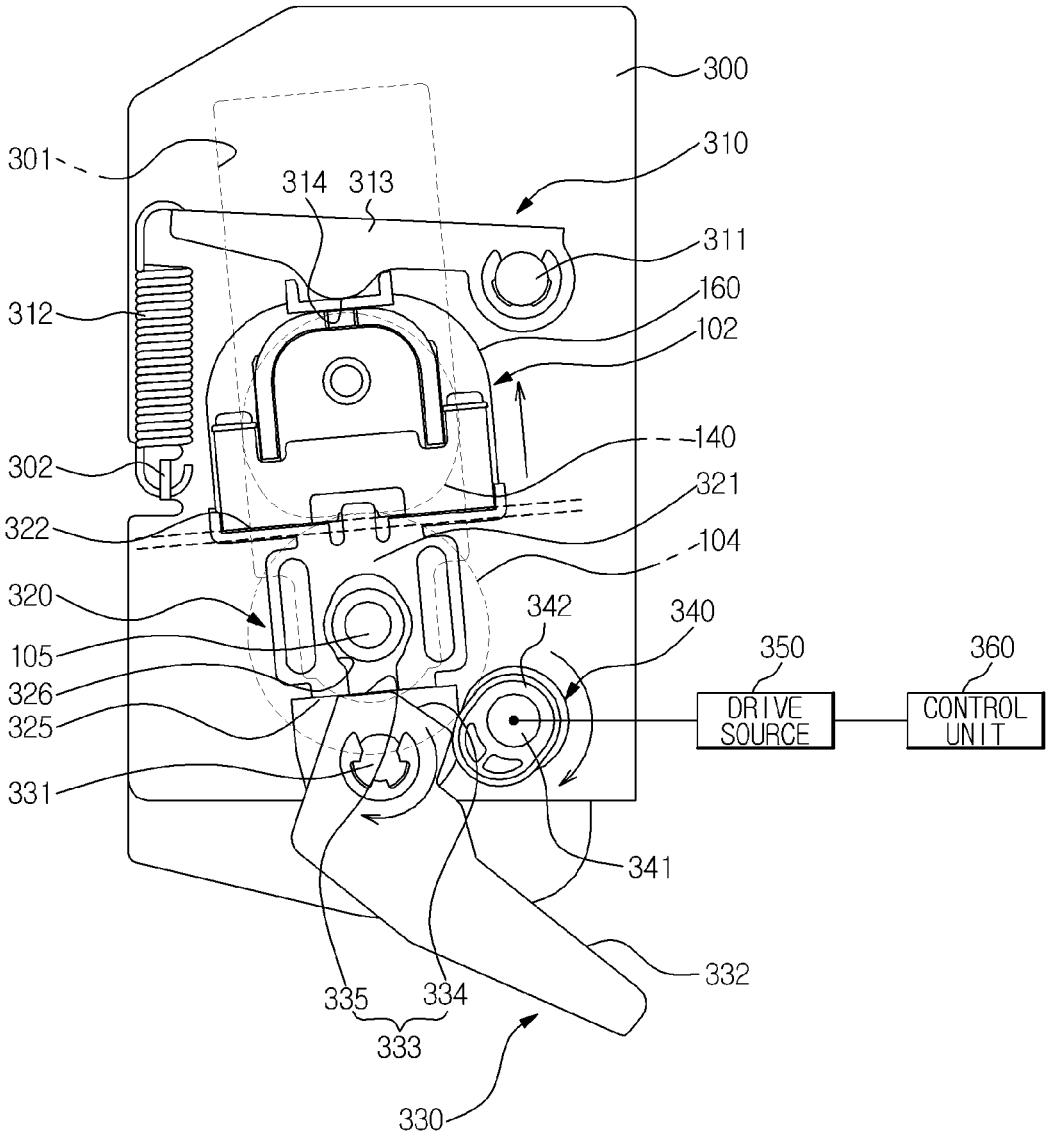
FIG. 8 illustrates a pressure release lever according to an exemplary embodiment.

FIG. 8 illustrates a pressure of the fusing nip between a pressure belt and the pressure roller released according to an exemplary embodiment.

The side frame 160, which rotatably supports the fusing belt 140, is slidably fitted into the guide groove 301 of the housing 300.

An upper end of the side frame 160 is supported by the pressure unit 310 and a lower end of the side frame 160 is supported by the position regulating device 320. A lower end of the position regulating device 320 may be supported by the pressure release lever 330 that is rotatably installed to a lower position of the housing 300.

The side frame 160 and the position regulating device 320 are slidably coupled to the housing 300 while being linked to each other, and are supported respectively by the pressure unit 310 and the pressure release lever 330.

The side frame 160 may be moved toward the pressure roller 104 when pressed by the pressure unit 310, thus defining the fusing nip N between the fusing belt 140 and the pressure roller 104.

The position of the fusing nip N may be fixed as the position regulating device 320 prevents the side frame 160 from being moved toward the pressure roller 104 beyond a preset range.

Thus, even if the outer diameter of the pressure roller 104 is locally changed by repeatedly applied heat and pressure, the position of the fusing nip N may always be fixed, thereby preventing shift of the delivery path of the recording medium S.

If the user operates the pressure release lever 330 when paper is jammed between the fusing belt 140 and the pressure roller 104, as illustrated in FIG. 8, the pressure release lever 330 is pivotally rotated, thus acting to press the position regulating device 320 with the nip release face 335 thereof. As the side frame 160 coupled to the position regulating device 320 is pressed along with the position regulating device 320, the pressure of the fusing nip N between the fusing belt 140 and the pressure roller 104 is released, enabling removal of the jammed paper.

The pressure release lever 330 may be rotated by the user, or the pressure release lever 330 may be rotated by operation of the cam unit 340 under control of the control unit 360.

Figure 9:
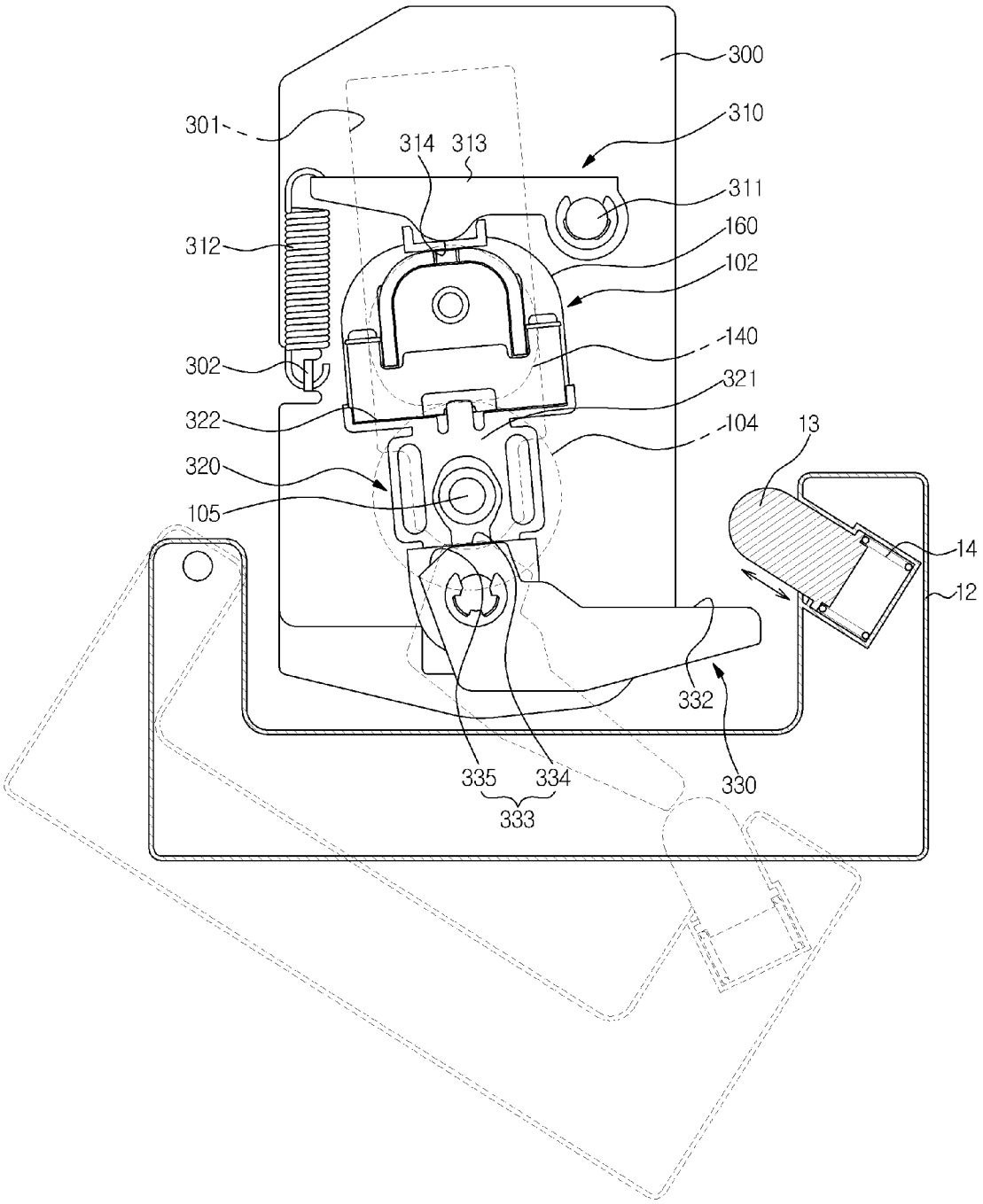
FIG. 9 illustrates a pressure release lever according to an exemplary embodiment.

The pressure release lever 330 may be directly rotated by the cam unit 340 or by the user, as illustrated in FIG. 9, the pressure release lever 330 may be rotated in linkage with operation of an outer structure, such as a cover 12 pivotally installed to one side of the main body 10.

The cover 12 may be provided with a locker member 13 which interferes with the lever portion 332 of the pressure release lever 330. The locker member 13 may be elastically supported by the spring 14 in a reciprocally movable manner.

Accordingly, as the pressure release lever 330 is pivotally rotated by the locker member 13 which interferes with the lever portion 332 upon opening of the cover 12, the pressure of the fusing nip N may be automatically released, which enables easy removal of the recording medium S and improves convenience of use.

According to an exemplary embodiment of the present invention, a fusing device and an image forming apparatus having the same, a position of a fusing nip may be fixed, which stabilizes a recording medium delivery, resulting in enhanced consistency of image quality.

Although exemplary embodiments of the present invention has been shown and described, it would be appreciated by those skilled in the art that changes may be made in these embodiments without departing from the principles and spirit of the invention, the scope of which is defined in the claims and their equivalents.

What is claimed is:

1. A fusing device, comprising:

a housing;

a pressure roller rotatably installed in the housing;

a heating unit arranged to face the pressure roller, the heating unit including a side frame slidably installed to the housing to rotatably support a film-shaped fusing belt inside of which a heat source is provided;

a pressure unit to press the side frame such that the fusing belt comes into close contact with the pressure roller while defining a fusing nip therebetween; and a position regulating device to support the side frame to regulate a position of the side frame when the side frame is pressed and moved by the pressure unit, thereby fixing a position of the fusing nip, the position regulating device arranged to perform a linear movement together with the side frame, wherein one side of the side frame is supported by the pressure unit and the other side of the side frame is supported by the position regulating device, and the position regulating device is slidably coupled to the housing.

2. The fusing device according to claim 1, wherein the position regulating device is movable between a first position to define the fusing nip upon receiving pressure applied by the pressure unit and a second position to release the pressure of the fusing nip.

3. The fusing device according to claim 2, wherein the pressure unit includes a pressure lever supported by an elastic member to press the side frame.

4. The fusing device according to claim 3, wherein one end of the pressure lever is pivotally rotatably coupled to a pressure lever rotating shaft and the other end of the pressure lever is supported by the elastic member, and a contact portion is formed at a middle position of the pressure lever so as to come into contact with the side frame.

5. A fusing device comprising:

a housing;

a pressure roller rotatably installed in the housing;

a heating unit arranged to face the pressure roller, the heating unit including a side frame slidably installed to the housing to rotatably support a film-shaped fusing belt inside of which a heat source is provided;

a pressure unit to press the side frame such that the fusing belt comes into close contact with the pressure roller while defining a fusing nip therebetween;

a position regulating device to regulate a position of the side frame when the side frame is pressed and moved by the pressure unit, thereby fixing a position of the fusing nip; and a pressure release lever rotatably installed to the housing and serving to press the position regulating device so as to move the position regulating device to the second position upon rotation thereof, wherein one side of the side frame is supported by the pressure unit and the other side of the side frame is supported by the position regulating device, and the position regulating device is slidably coupled to the housing, wherein the position regulating device is movable between a first position to define the fusing nip upon receiving pressure applied by the pressure unit and a second position to release the pressure of the fusing nip.

6. The fusing device according to claim 5, wherein the pressure release lever includes a pressure release lever rotating shaft, a lever portion extending in a given direction from the pressure release lever rotating shaft, and a cam face extending in an opposite direction from the pressure release lever rotating shaft so as to come into contact with the position regulating device.

7. The fusing device according to claim 6, wherein the cam face includes a nip defining face spaced apart from a rotation center of the pressure release lever rotating shaft by a first distance and a nip release face spaced apart from the rotation center of the pressure release lever rotating shaft by a second distance.

8. The fusing device according to claim 6, further comprising a cam unit to come into contact with the lever portion when rotated by a drive source, so as to rotate the pressure release lever.

9. The fusing device according to claim 6, wherein the lever portion is rotated in linkage with operation of an outer structure adjacent thereto.

10. The fusing device according to claim 8, further comprising a control unit to control the drive source so as to adjust a rotation angle of the lever portion based on the kind of a recording medium fed to the fusing device.

11. The fusing device according to claim 6, wherein the position regulating device includes a first coupling portion coupled to the side frame, a second coupling portion having a vertically elongated slot into which the pressure release lever rotating shaft is fitted, and a cam contact portion to come into contact with the cam face of the pressure release lever.

12. An image forming apparatus comprising a fusing device to heat a non-fused image on a recording medium so as to fuse the image to the recording medium, wherein the fusing device includes:

a housing;

a heating device having a side frame slidably installed to the housing to rotatably support a film-shaped fusing belt inside of which a heat source is provided;

a pressure roller rotatably installed in the housing so as to face the heating device;

a pressure unit installed to the housing and serving to press the side frame toward the pressure roller so as to define a fusing nip between the fusing belt and the pressure roller;

a position regulating device to regulate a position of the side frame when the side frame is moved by the pressure unit, so as to prevent shift of a position of the fusing nip due to deformation of the pressure roller; and a pressure release lever installed to the housing so as to be rotatable by a predetermined angle and serving to press the position regulating device upon rotation thereof so as to release pressure of the fusing nip between the fusing belt and the pressure roller, wherein the pressure unit includes a pressure lever coupled to a shaft, and wherein one side of the position regulating device is supported by the side frame and the other side of the position regulating device is supported by the pressure release lever.

13. The image forming apparatus according to claim 12, wherein the position regulating device is movable between a first position to define the fusing nip and a second position to release the pressure of the fusing nip.

14. The image forming apparatus according to claim 13, wherein the pressure unit includes a pressure lever, one end of which is rotatably supported by the housing and the other end of which is supported by an elastic member to press the side frame.

15. The image forming apparatus according to claim 14, wherein the position regulating device prevents the side frame from being moved toward the pressure roller beyond the first position by the pressure lever.

16. The image forming apparatus according to claim 13, wherein the pressure release lever rotatably installed to the housing is provided at one end thereof with a cam face to come into contact with the position regulating device and at the other end thereof with a lever portion to pivotally rotate the pressure release lever.

17. The image forming apparatus according to claim 16, wherein the cam face includes a nip defining face to keep the position regulating device at the first position and a nip release face to keep the position regulating device at the second position.

18. The image forming apparatus according to claim 17, wherein the fusing device includes a cam unit to come into contact with the lever portion when rotated by a drive source, so as to rotate the pressure release lever.

19. The image forming apparatus according to claim 18, further comprising a control unit to control the drive source, wherein the control unit operates the drive source so as to control a rotation angle of the lever portion based on the kind of a recording medium delivered into the fusing device.

20. The image forming apparatus according to claim 17, further comprising a cover to open or close one side of a main body, wherein the lever portion is operated in linkage with operation of the cover.

* * * * *